United States Patent [19]

Ainoya et al.

[11] Patent Number: 4,929,982

[45] Date of Patent: May 29, 1990

[54] SHEET PATH IN AN ELECTROPHOTOGRAPHIC PRINTER

[75] Inventors: Masayuki Ainoya, Mito; Takeyuki Ishihara, Yokohama; Tesuo Kanno, Fujisawa; Takahiro Kikuchi, Katsuta; Seiichi Mori, Fujisawa; Shogo Nobumori; Junji Shirakawa, both of Katsuta, all of Japan

[73] Assignee: International Business Machines Corporation, Armonk, N.Y.

[21] Appl. No.: 353,846

[22] Filed: May 18, 1989

[30] Foreign Application Priority Data

May 25, 1988 [JP] Japan ..... 63-126019

[51] Int. Cl.[5] ..... G03G 15/00

[52] U.S. Cl. ..... 355/311; 355/310; 355/313; 355/312; 355/274

[58] Field of Search ..... 355/311, 310, 308, 309, 355/312, 313, 271, 273, 274

[56] References Cited

U.S. PATENT DOCUMENTS

| | | | |
|---|---|---|---|
| 3,893,760 | 7/1975 | Thettu | 355/312 X |
| 4,191,467 | 3/1980 | Schieck | 355/75 |
| 4,320,952 | 3/1982 | Seimiya et al. | 355/312 |
| 4,362,378 | 12/1982 | Erskine et al. | 355/274 |
| 4,408,866 | 10/1983 | Gustafson | 355/312 X |
| 4,417,800 | 11/1983 | Hirose et al. | 355/312 X |
| 4,466,729 | 8/1984 | Iwata | 355/274 X |
| 4,699,496 | 10/1987 | John et al. | 355/311 X |
| 4,714,946 | 12/1987 | Bajgert et al. | 355/311 X |
| 4,843,429 | 6/1989 | Avritt et al. | 355/274 |

FOREIGN PATENT DOCUMENTS

| | | |
|---|---|---|
| 0217133 | 4/1987 | European Pat. Off. . |
| 3801201 | 7/1988 | Fed. Rep. of Germany . |
| 56-85764 | 7/1981 | Japan . |

OTHER PUBLICATIONS

Patent Abstracts of Japan, vol. 9, No. 141, p. 364, Entitled "Electrophotographic Recording Device" (Ricoh K.K.), Jun. 15, 1985.

Patent Abstracts of Japan, vol. 6, No. 46, p. 107, Mar. 24, 1982, Entitled "Fixing Device for Copying Machine" (Sharp K.K.).

Patent Abstracts of Japan, vol. 6, No. 53, p. 109, Apr. 8, 1982, Entitled "Fixation Control System" (Ricoh K.K.).

Patent Abstracts of Japan, vol. 9, No. 177, Jul. 23, 1985, Entitled "Image Forming Device" (Canon K.K.).

*Primary Examiner*—A. C. Prescott

*Attorney, Agent, or Firm*—Charles E. Rohrer

[57] ABSTRACT

An electrophotographic printer of the transfer type with separate input bins for holding cut sheet print material and fan-fold form print material. Separate paper paths are provided from each bin to a first function. An input paper path is provided for moving either cut sheet or fan-fold forms from the first function to the transfer station. An output paper path is provided for moving either cut sheet or fan-fold forms from the transfer station through the fuser to a second function. Separate paper paths are provided from the second fuction to stack cut sheet material and fan-fold forms in separate output bins.

9 Claims, 4 Drawing Sheets

SHEET PATH IN AN ELECTROPHOTOGRAPHIC PRINTER

BACKGROUND OF THE INVENTION

This invention relates to an electrophotographic printer for selectively feeding fan-fold forms and cut sheets and for printing on optionally selected forms. In particular, this invention relates to an electrophotographic printer which features the mechanism for handling both types of forms within the printer.

Electrophotographic printers are generally constituted to operate as single-function printers which use cut sheets or fan-fold forms.

In a place where both cut sheets and fan-fold forms are used, therefore, separate printers for each form must be installed, which requires a large floor space and access area. Also, a separate power source, consumables and maintenance parts are required for each printer, resulting in complexity in use and maintenance. Furthermore, since printers must be changed each time the form changes, these printers are inconvenient.

To solve the problems described above, various printers have been proposed which enable printing on both fan-fold forms and cut sheets. By the use of such proposed printers, the above problems can be solved.

However, although proposed printers for both fan-fold forms and cut sheets have a structure which uses a transfer means, such as photosensitive drum in common for both forms, the form handling means installed before and after the transfer means must be separate for each form, thus resulting in an increase in the complexity and size of the printers.

It is the main object of this invention to provide a printer for selectively printing on both cut sheets and fan-fold forms, wherein the components can be used in common to a great extent.

In practice, however, since the form feeding, form conveying speed, relative positions of the photosensitive drum and forms, and stacking conditions depend on the forms used, the printer is required to handle each form within the printer to meet the requirements for printing on each form.

It is another object of this invention to provide an electrophotographic printer which enables printing and conveying conditions to be set selectively to meet the requirements of both cut sheets and fan-fold forms.

SUMMARY OF THE INVENTION

The above objects are achieved by the electrophotographic printer of this invention which comprises a photosensitive drum; a form feeder having a means for feeding cut sheets to the photosensitive drum and a means for feeding fan-fold forms to the photosensitive drum, both of which are installed in parallel to the photosensitive drum; a frame driven toward the photosensitive drum to allow forms fed by the feeder means to make contact with the photosensitive drum; a transfer means installed on the frame for transferring images on the photosensitive drum on to the forms which make contact with the drum; a conveyor belt for sucking forms from the transfer means with a suction pressure and conveying the forms; a fixing means for fixing transferred image on the forms conveyed by the conveyor belt; and a form discharging means for discharging the forms from the fixing means.

Since the drum speed, including the stop, the gap between the drum and the frame of the transfer means, the form suction force of the conveyor belt, and the speed of the conveyor belt and the puller can be controlled separately depending on the forms used, the electrophotographic printer of this invention can be used in common for both cut sheets and fan-fold forms by installing separate form feeders and form discharging means.

DETAILED DESCRIPTION OF THE PREFERRED EMBODIMENT

In these drawings, the same numerals are used to indicate the same components.

Figure 1:
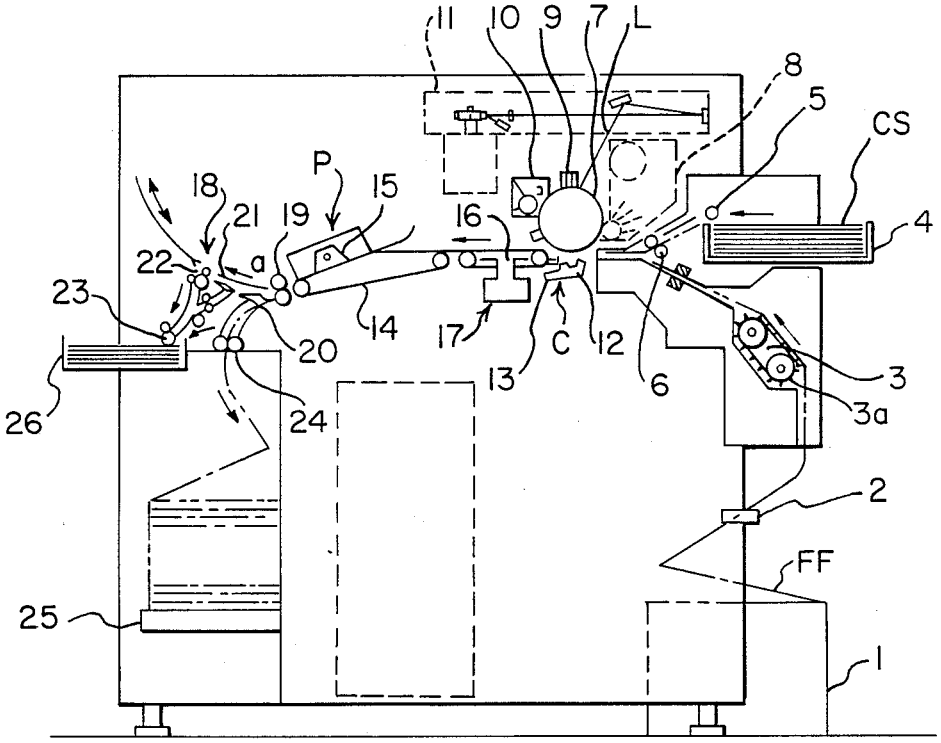
FIG. 1 is a cross-sectional side view illustrating the entire structure of an embodiment of this invention.

Referring first to FIG. 1, the construction of the printer of this invention will be described.

Numeral 1 indicates a stocker of fan-fold forms FF installed on the bottom (bottom right in FIG. 1) of the printer body M; numeral 2 indicates an EOF sensor for detecting the end of the forms, which is installed on the feeding path of the forms FF; and numeral 3 indicates a tractor for conveying the forms FF to the transfer section C described later, which is also installed on the feeding path of the fan-fold forms. The tractor 3 is provided with pins *3a* on the surface of the belt at the same pitch as the sprocket holes perforated on both edges of the fan-fold forms. The fan-fold form feeding path is composed of components 1–3 and guide plates to the location immediately before the transfer section C.

Numeral 4 indicates a cassette for cut sheets CS, which is installed on the printer body M above the fan-fold form stocker 1; numeral 5 indicates a pick-up roller installed on the outlet of the cassette 4; and numeral 6 indicates an alignment roller for correcting skewing, which is installed in the feeding path for cut sheets CS after the pick-up roller 5. The cut sheet feeding path is composed of components 4–6 and guide plates to the location immediately before the transfer section C.

These two form feeding paths join at the location immediately before the transfer section C described below, and in the printer of this invention, either forms FF or CS are selectively fed into the transfer section C.

Figure 2:
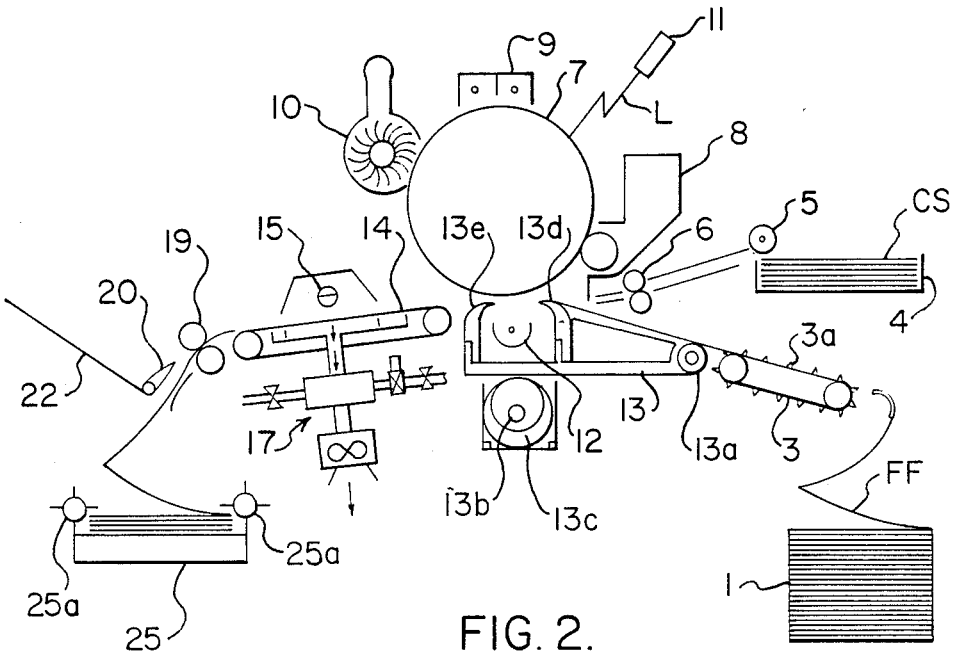
FIG. 2 is a cross-sectional side view illustrating the main part of the printer shown in FIG. 1.

Referring now to FIGS. 1 and 2, the construction of the transfer section C and the fixing section P will be outlined.

Numeral 7 indicates a photosensitive drum installed after the end of and above the form paths. Around the outer surface of the drum 7, except the bottom surface, are installed a developing means consisting of a toner feeder 8, a charger 9 and a cleaner 10, and these are arranged so as to allow the laser beam L from a laser optical system 11 to radiate the outer surface of the drum 7. The drum 7 is driven by a motor with controllable speed including stop, such as a stepping motor (not shown).

Under the drum 7 is installed a frame 13 with a transferring corotron 12, which is retractable from the drum surface.

The frame 13, either right side or left side, is mounted so as to pivot on a shaft 13*a* parallel to and below the drum 7 and deviated from the center line of the drum 7, and the bottom of the frame 13 is supported by an eccentric cam 13*b*. The gaps between the lower surface of the drum 7 and the upper surfaces of gap adjusting guides 13*d*, 13*e* provided before and after the transfer corotron 12 in the frame 13 is adjusted according to the type of form. The cam 13*b* is driven by a motor whose angle of rotation can be controlled, such as a stepping motor 13*c*.

Thus, either cut sheets CS or fan-fold forms FF, when the drum 7 rotates, are guided by the guides 13*d*, 13*e*, and pass between the drum 7 and the transfer corotron 12, contacting the outer surface of the drum 7, so that toner images on the photosensitive drum 7 are transferred on to the forms electrostatically by corona discharge. The transfer section C is constituted of components from the photosensitive drum 7 through gap adjusting guides 13*d*, 13*e*.

Numeral 14 indicates a conveyor belt in the fixing section P where images transferred to the forms are fixed, and numeral 15 is a fuser unit mainly consisting of flash lamps. Although another conveyor belt 16 is used before the conveyor belt 14 in the fixing section P in the embodiment shown in FIG. 1, this belt 16 is not essential, and is optionally installed depending on the length of the form paths.

The conveyor belt 14 or 16 adjacent to the drum 7 is provided with a suction means 17 for sucking the forms passing through the transfer section C to prevent electrostatic attraction of the forms by the drum 7. Although it is not shown in FIGS. 1 and 2, a separating corotron 13*g* is installed before the conveyor belt 14 or 16 in the vicinity of the drum 7 (see FIGS. 3 through 6).

Numeral 18 indicates a form discharging means installed after the front end of the conveyor belt 14 in the fixing section P, and is composed, in this embodiment, of a discharging puller 19 which takes the forms into the discharging paths, a first flapper 20 which branches the discharging paths for cut sheets CS and fan-fold forms FF, a second flapper 21 which sends cut sheets CS to an accompanying reversing means 22, a discharging roller 23, and a stacker puller 24.

Numerals 25 and 26 indicate stackers for respective forms which are installed below exits for respective forms, and numeral 25*a* is paddles of the stacker 25.

The printer of this invention outlined above is provided with unique mechanisms as described below in order to handle cut sheets and fan-fold forms of different thickness and conveying conditions without trouble in the same transfer section C and fixing section P.

In this type of printer, which can selectively print on both fan-fold forms and cut sheets, since the optimal distance between the photosensitive drum 7 in the transfer section C and the guides 13*d*, 13*e* on the frame 13 differs for fan-fold forms and cut sheets, the following problems will arise.

When fan-fold forms are used, the forms are subjected to tension because the discharging puller 19, which takes the forms into the form discharging means 18, is driven slightly faster than the tractor 3. In this case, the optimal distance between the drum 7 and the retractable frame 13 is approximately 0.5 mm, and the larger distance affects contact of the drum 7 and the forms FF and lowers transfer efficiency.

On the other hand, when cut sheets, which are not subjected to tension on conveying, are used, the optimal distance between the drum 7 and the transfer corotron 12 on the frame 13 is approximately 0.8 mm, and the smaller distance may cause conveying trouble such as jamming. If the distance between the drum 7 and the transfer corotron 12 on the frame 13 is too wide, contact of the drum 7 and the forms CS is affected causing poor transfer, particularly when thick forms are used.

This invention aims at solving the above problems in prior art printers, and provides an efficient transfer mechanism for printing on both continuous and cut sheets without conveying trouble.

The inventors noticed the movement of the frame 13 with guides 13*d*, 13*e* which approach the photosensitive drum 7 during printing, and go away from the drum 7 when not printing, and used a motor 13*c* whose angle of rotation can be controlled, such as a stepping motor, for controlling the position of the frame 13 so that an adequate distance between the drum 7 and the transfer corotron 12 for both the fan-fold forms FF and cut sheets CS is obtained.

In FIG. 2, the cut sheets CS stacked on a feeder cassette 4 are picked up one after one by a pickup roll 5, and sent by the feed roller 6 with a skewing correction mechanism to the gap between the photosensitive drum 7 and the upper surface of the transfer corotron 12 on the frame 13, where images are transferred on to the forms by the transfer corotron 12.

The forms are then conveyed by the conveyor belt 14, and after the toner on the forms is fixed by the flash light in the fixing section P, the forms are discharged through the form discharging path to a stacker 26 by a discharging puller 19. Here, the frame 13 of the transfer corotron 12 is placed on an eccentric cam 13*b* fixed to the output shaft of the stepping motor 13*c*, and is elevated or lowered around the shaft 13*a* by the rotation of the motor 13*c*. Thus, the distance between the drum 7 and the upper surface of the frame 13 can be changed by elevating or lowering the frame 13 relative to the drum 7.

The relationship between the angle of rotation of the stepping motor 13*c* and the upper surface of the transfer corotron 12 is, for example, as follows.

When printing is not performed, the stepping motor 13*c* is excited to a phase angle of 0° (the lower dead point of the eccentric cam), and the distance between the photosensitive drum 7 and the frame 13 becomes the maximum.

When cut sheets are used, the motor 13*c* is excited to rotate 143°, and the distance between the drum 7 and the frame 13 is maintained at about 0.8 mm. When fan-fold forms are used, the motor 13*c* is excited to rotate 180° (the upper dead point of the eccentric cam), and the distance between the drum 7 and the frame 13 is maintained at about 0.5 mm.

By the construction described above, since the distance between the photosensitive drum 7 and the transfer corotron 12 on the frame 13, which guides the forms can be set to an adequate value for either fan-fold forms FF or cut sheets CS, the printer, with little form conveying trouble, can be constituted without lowering transfer capacity.

Figure 3:
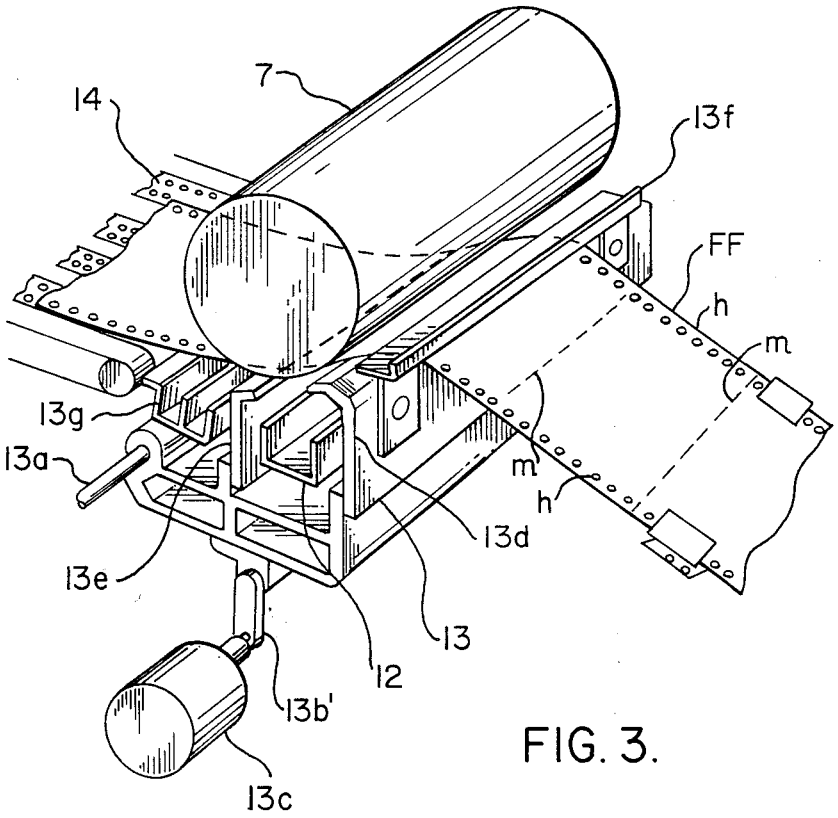
FIG. 3 is a perspective view of an embodiment of the transfer means used in the printer shown in FIG. 1.

In the transfer section C of the printer having the retractable frame 13 of the transfer corotron 12 of the construction described above, the frame 13 is moved to the vicinity of the photosensitive drum 7 when printing is started on fan-fold forms FF, as shown in FIG. 3 by the action of the motor 13*c* and a link 13*b*', equivalent to the cam 13*b* of FIG. 2, and allows the forms to approach the photosensitive drum 7. At the same time, the toner on the drum 7 is transferred on to the forms by the corona discharge of the transfer corotron 12, and synchronizing the stop of printing, the frame 13 is retracted below the drum and functions to separate the forms from the drum 7.

In this transfer section C, the conventional retractable frame 13 was provided with guides 13*d* and 13*e* before and after the transfer corotron 12, respectively. These guides 13*d*, 13*e* were used for allowing the forms to contact with the drum 7 during printing, and were so adjusted that both the distance between the guide 13*d* and the drum 7 and the distance between the guide 13*e* and the drum 7 are equally about 0.5–0.8 mm.

However, when thick cut-sheet forms CS, which are difficult to bring into contact with the drum 7, are used in the transfer section C of the printer of this invention, the gap between guides 13*d*, 13*e* and the drum 7 of 0.5–0.8 mm, as in conventional printers, may cause jamming of the forms because it is difficult for the end of a form to enter into the gap.

To solve the problem arising when thick cut-sheet forms CS are used as described above, the elimination of the guide 13*e* on the exit side might be considered. In such a construction, however, when fan-fold forms FF are used, the adhesion of the forms FF with the drum 7 may decrease, resulting in poor transfer. Also, even when cut-sheet forms CS are used, another problem may arise in that after the rear end of a form has passed through the front guide 13*d*, transfer is missed in the vicinity of the rear end of the form, because there is no guide to control the form to cause it to make contact with the surface of the drum 7.

Considering such problems, in this invention, in which forms conveyed by guides 13*d*, 13*e* are allowed to contact the drum 7 by making the distance between the guide 13*e* in the exit side of the transfer section C and the drum 7 larger than the distance between the guide 13*d* in the inlet side of the transfer section C and the drum 7.

Such an embodiment will be described referring to FIG. 6.

Figure 6:
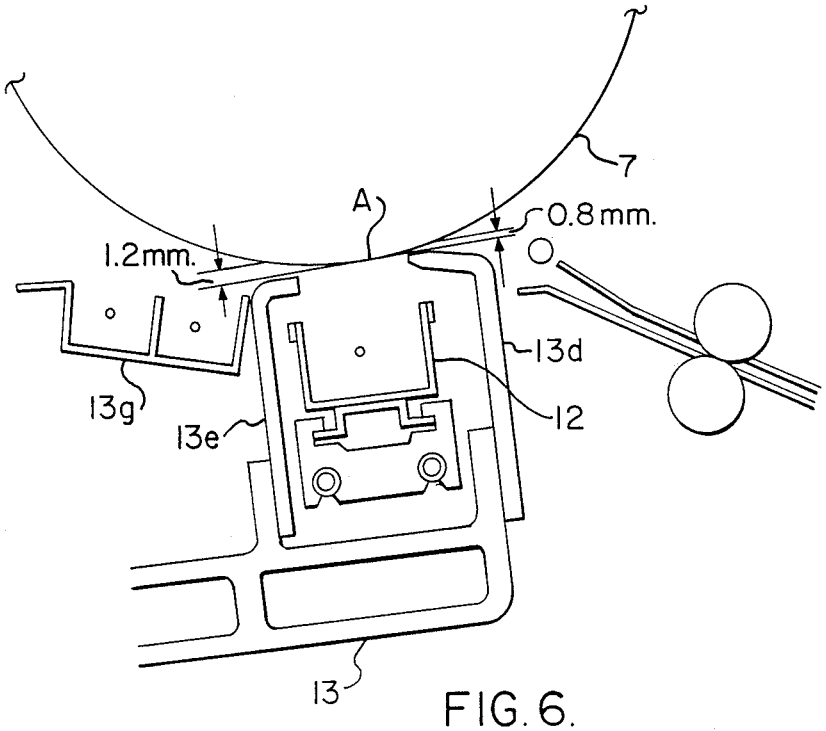
FIG. 6 is an enlarged cross-sectional side view of the transfer means shown in FIG. 3 to which additional components are installed.

In FIG. 6, the front (right-hand side in FIG. 6) guide 13*d* faces the drum 7 with a gap of about 0.8 mm. The guide 13*e* on the exit side faces the drum 7 with a gap of about 1.2 mm. Both guides 13*d*, 13*e* are supported so that the tangent at point A on the drum 7 is flush with the upper surfaces of these guides 13*d*, 13*e*.

By this construction, the front end of a cut form, after passing through the guide 13*d*, contacts the drum 7, and is conveyed in the tangential direction of the drum 7. In this time, since an electrostatic force is applied to the form to attract it toward the drum 7 by the corona discharge of the transfer corotron 12, the form is actually conveyed upward from the tangential direction of the drum and passes over the guide 13*e* on the exit side, preventing jamming due to the end of a form running against the guide 13*e*. Even after the rear end of the form has passed through the guide 13*d* and the form is no longer restricted by the guide 13*d*, the form is restricted on the surface of the drum 7 by the guide 13*e*, and satisfactory transfer can be achieved.

By the construction as described above, contact of the forms with the drum is ensured, and the distance between the frame 13 of the transfer corotron 12 at the outlet side of the transfer section C and drum 7 can be increased. Thus, a printer with little form conveying trouble can be produced without lowering the transfer performance.

On the other hand, the printer having form guides in the transfer section C as shown in FIGS. 3 and 6 has the following problems when fan-fold forms FF are used.

During printing, toner on the drum 7 is transferred on to desired pages of the fan-fold forms FF by corona discharge of the transfer corotron 12. When printing is stopped, the frame 13 of the transfer corotron 12 is retracted downward away from the drum 7 by the action of the cam 13*b* or the link 13', and the forms are separated from the drum 7.

In this type of printer, however, since printing is performed on each page, folding scores m come to the printing position when printing on each page has been completed.

Figure 5:
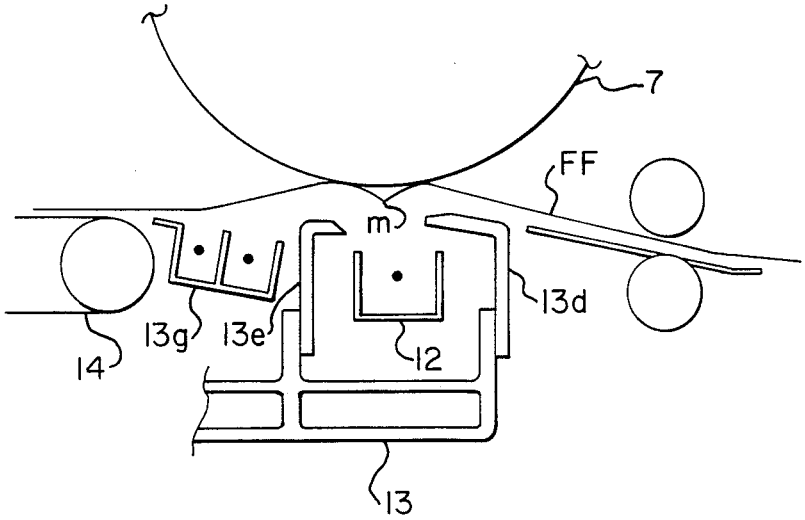
FIG. 5 is an enlarged cross-sectional side view of the main part of the transfer means used in a prior art printer.

Therefore, as shown in FIG. 5, when thick fan-fold forms FF are used, sagging is caused due to creases at scores m and to the stiffness of the form, the forms may contact the drum 7 even though the frame 13 is retracted, and the vicinity of the scores m may be contaminated by the toner.

In order to eliminate the sagging of thick forms, tension might be increased by increasing the speed of the conveyor belt 14 or the peripheral speed of the discharging puller 19. However, when thin forms are used, another problem will arise in that the forms are easily torn at scores m, or the forms may run off the pins 3*a* of the tractor 3.

In this invention, therefore, the sagging of fan-fold forms when printing is stopped is minimized and the forms are pressed to the frame 13 by installing a member to guide the upper surface of the form above the guide 13*d* on the frame 13 of the transfer corotron 12.

In FIG. 3, a form presser guide 13*f* is provided above the inlet guide 13*d* to the frame 13 of the transfer corotron 12 so as to press the form from the top. The presser guide 13*f* is fixed to the guide 13*d* of the frame 13 to maintain a gap through which the forms pass. Therefore, the presser guide 13*f* is moved upward or downward when printing is started or stopped while maintaining the gap between the presser guide 13*f* and the upper surface of the guide 13*d* of the frame 13.

Figure 4:
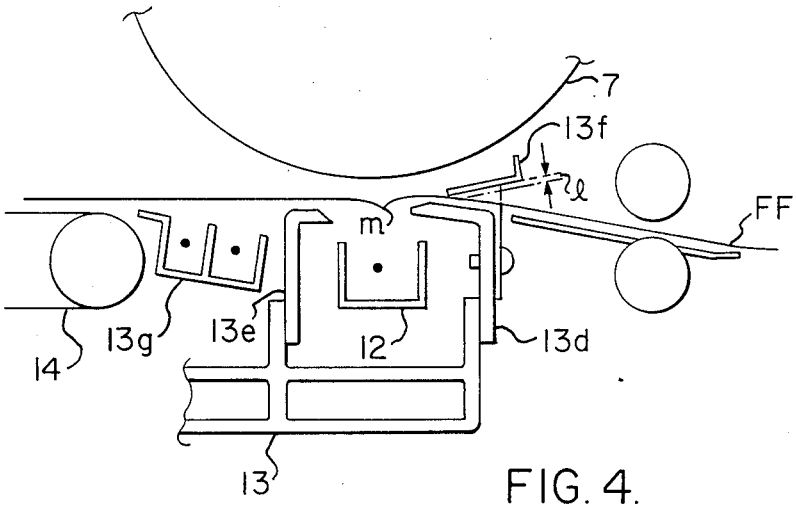
FIG. 4 is an enlarged cross-sectional side view of the main part of the transfer means shown in FIG. 3.

FIG. 4 is a cross-sectional view showing a printing stop condition. In FIG. 4, although the frame 13 is retracted away from the drum 7, since the presser guide 13*f* presses the form FF from the top, the sagging of the form is avoided resulting in the contact of the form FF with the drum 7 which causes contamination of the form by the toner.

Here, the gap between the upper surface of the guide 13*d* of the frame 13 and the presser guide 13*f* must be at least wide enough to enable the form of the maximum thickness usable in the printer to pass. However, since too large a gap lowers the effect of the presser guide 13*f*, the gap is preferably 0.2–0.5 mm.

By the installation of the presser guide 13*f* as described above, the contact of the form with the drum 7 due to the sagging of fan-fold forms at the transfer position in the transfer section C when printing is stopped is avoided, and the contamination of the forms by the toner is prevented.

On the other hand, in such a printer, the fan-fold forms are restricted by the tractor 3 and the discharging puller 19. That is, the puller 19 is driven at a peripheral speed several percent faster than the feed speed of the tractor 3 to apply tension to the fan-fold forms so as not produce creases or sagging during printing.

When printing on fan-fold forms is completed and the forms are switched to cut-sheet forms, the fan-fold form is cut using a cutter (not shown) for discharging.

Since the cutter is placed between the tractor 3 and the discharging puller 19, when the form FF is cut, the form FF is separated from the tractor and no longer subjected to tension, causing sagging.

Also, even after the drum has been cleaned by the cleaner 10, a trace of toner remains on the surface of the drum 7. Therefore, if sagging occurs after the printed fan-fold form has been cut, the form contacts the surface of the drum 7, and if the drum is rotated then, the form being discharged toward the puller 19 is rubbed by the drum 7, and the part of the form under the drum 7 will be contaminated.

However, if the photosensitive drum 7 is stopped when the form is cut, the form is not rubbed by the rotating drum 7 and toner remaining on the drum surface is not accumulated at the part where the form contacts with the drum 7, and contamination of the form under the drum 7 can be ignored.

As described above, when a fan-fold form is cut in the printer, the form is not rubbed by the surface of the drum 7 by stopping the drum 7 even if the form contacts with the drum 7, and contamination as in conventional printers is minimized.

Next, when the printer has the construction for selectively handling fan-fold forms FF and cut forms CS as described above, the optimal value of the peripheral speed of the discharging puller 19 and the speed of the conveyor belt 14 should be set to differ for fan-fold forms FF and cut-sheet forms CS.

The reason is that when fan-fold forms FF, whose speed is controlled by the tractor 3, is used, the adequate peripheral speed of the discharging puller 19 and the speed of the conveyor belt 14 is about 7–10% higher than the form conveying speed (the speed of the tractor 3) for applying tension to the forms. If these speeds are lower, tension applied by the discharging puller 19 is lowered and sagging occurs in forms, causing poor printing.

When cut-sheet forms CS, whose speed is not controlled by the tractor 3 are used, the form conveying speed is equal to the peripheral speeds of the feeder roll 6, the photosensitive drum 7, discharging puller 19, and the speed of the conveyor belt 14 at each location. Therefore, the adequate speed of the conveyor belt 14 and the discharging puller 19 are equal to, or at greatest, 2% higher than the form conveying speed. If these speeds are higher, the form conveying speed becomes higher than the peripheral speed of the photosensitive drum and printed images are stretched, causing poor printing.

To solve such problems, the printer of this invention ensures that adequate form conveying speed can be achieved in the transfer section C for both fan-fold forms FF and cut-sheet forms CS, and good printing quality can be obtained.

Figure 7:
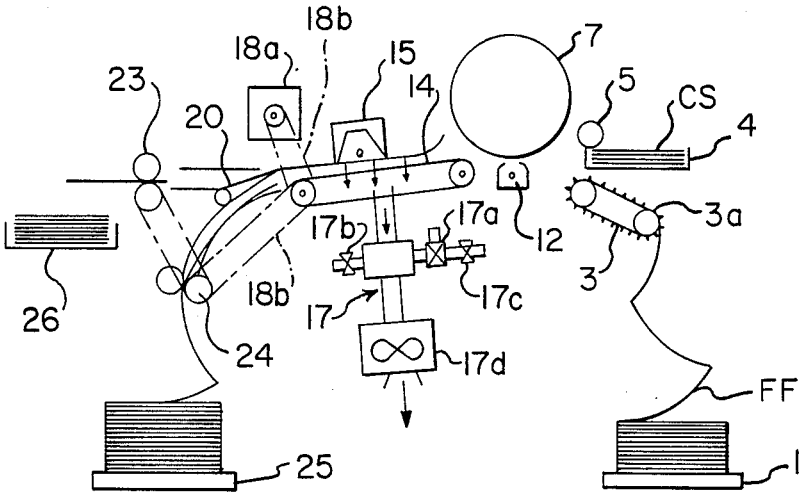
FIG. 7 is a cross-sectional side view illustrating an embodiment of the suction means of the conveyor belt in the fixing section.

In the printer of this invention, in order to change speeds of the discharging puller 19 and the conveyor belt 14 depending on the type of forms, a speed controllable motor 18*a*, such as a stepping motor, is used as the drive power source for the discharging puller 19 and the conveyor belt 14 in common with the drive for the discharging means 18 but independent from other drive power sources for conveying. The motor 18*a* is controlled to achieve the adequate speed of the discharging puller 19 and the conveyor belt 14 for both fan-fold forms FF and cut-sheet forms CS, as FIG. 7 shows.

Since the speed of the discharging puller 19 and the conveyor belt 14 can be controlled independently from other form conveying mechanisms by the independent drive, the control section (not shown) of the printer, on receiving printing start instruction, determines whether the form is the fan-fold form or the cut-sheet form, and controls the motor 18*a* to achieve optimal speed of the discharging puller 19 and the conveyor belt 14 for each form. In FIG. 7, reference 18*b* indicates a transmission belt.

By the construction described above, since the optimal form conveying speed for each form can be set in the transfer section C, the printer for high-quality printing can be constructed.

Even in a printer which can selectively print on the fan-fold forms and cut-sheet forms, the different peripheral speed of the photosensitive drum 7 for fan-fold forms FF and cut-sheet forms CS is preferable.

When fan-fold forms are used, since feed speed is controlled by the tractor 3, and tension is applied to the forms FF by the discharging puller 19 and the conveyor belt 14, the form conveying speed is substantially equal to the speed of the tractor 3.

Here, although difference from the peripheral speed of the drum 7 does not affect the form conveying speed directly, if the peripheral speed of the drum is higher than the speed of the tractor 3, and the sum of the form conveying force by the electrostatic attraction of the drum 7 and tension produced by the puller 19 and the conveyor belt 14 exceeds the form controlling force by the tractor 3 and the sprocket holes h of forms, the sprocket holes h of the fan-fold forms may tear. Therefore, the peripheral speed of the photosensitive drum 7 should be slightly lower than the form conveying speed considering the tolerances of components such as the outer diameter of the photosensitive drum.

On the other hand, when cut-sheet forms CS, which are not controlled by the tractor are used, form conveying speed equals to the speed of the feed roll 6, photosensitive drum 7, conveyor belt 14 and discharging puller 19 at each location, and difference from the peripheral speed of the drum 7 directly affects the extension or contraction of the printed image. Therefore, the peripheral speed of the photosensitive drum 7 should be set to be exactly equal to the standard form conveying speed.

Thus, the printer of this invention ensures that the optimal form conveying speed is achieved for both fan-fold forms FF and cut-sheet forms CS and high-quality printing can be obtained.

Thus, the printer of the invention is arranged to ensure an optimum feed speed in the transfer section C for both fan-fold form FF and cut-sheet form CS so as to obtain good print quality.

Namely, in this invention, consideration is given to the fact that an excellent feed speed can be obtained for both the fan-fold and the cut-sheet form by varying the speed of the photosensitive drum 7, and provision is made to use a motor, the speed of which can be controlled, such as a stepping motor in the driving source (not shown) of the photosensitive drum 7 separately from that for other form conveyor mechanism to control the speed of the photosensitive drum 7 so that the optimum form conveyor speed can be obtained both in printing the fan-fold form and in printing the cut-sheet form.

Employing this arrangement allows the photosensitive drum 7 to have the driver section independent from that of the other form conveyor mechanism, and enables it to be independently controlled, so that, although not shown, the control section of the printer according to the invention can determine whether printing is for the fan-fold form or the cut-sheet form when it receives a print start instruction from the host controller, and control drive of the motor, which is the driving source of the photosensitive drum 7, to obtain a photosensitive drum speed best suitable for each form.

Employing the above-mentioned arrangement allows the form conveying speed at the transfer section C to be set at an optimum value for the fan-fold form FF and the cut-sheet form CS, so that it is possible to arrange a printer that can perform good printing regardless of the type of form.

The printer with the above-mentioned arrangement is designed to separate the form, which is electrostatically attached to the drum 7, from the drum surface with a conveyor belt 14 after the toner on the drum 7 is transferred to the form, to feed it to the fixing section P where the toner on the form is fixed to the form by the flash light from the fuser unit 15.

The conveyor belt 14 causes a sucking force, by suction pressure, to act on the bottom surface of the form to separate the form from the surface of the drum 7, and to convey it a location below the fuser unit 15 in the fixing section P.

Such a suction mechanism may cause improper conveying to occur because, when the cut-sheet form is separated from the drum 7, insufficient suction pressure during feeding of the cut-sheet forms may cause a cut-sheet form to slip on the conveyor belt 14, or a curled and warped sheet to abut other components.

On the other hand, during feeding of the fan-fold form, because tension acts between the tractor 3 and the discharging puller 19, and the conveyor belt 14, if the suction pressure is too high, an increase of the tension acting on the form will result in the tearing of the feed perforation h by the pin 3*a* of the tractor 3, or, because the load applied to the conveyor belt 14 increases, it becomes necessary to increase the size of the stepping motor 18*a* for driving the conveyor belt 14, or that of a driver for controlling the motor (not shown). Thus, wear and aging in the driving section become noticeable. There, a problem arises in which the aging further increases the load torque on the conveyor belt 14 to cause the stepping motor 18*a* to step out.

Then, in the printer according to the invention consideration is given to fact that the optimum value of the suction pressure acting on the conveyor belt 14 varies for the fan-fold form and the cut-sheet form CS, and is arranged, as shown in FIG. 7, in such a manner that a solenoid valve 17*a* for changing the pressure is added to the suction mechanism 17 so that the suction pressure can be independently set in the feeding of the fan-fold form and the feeding of the cut-sheet form.

An embodiment of this arrangement is described by referring to FIG. 7.

In FIG. 7, a change-over flapper 20 in the form discharging path is directed downward at its front end in the printing of the cut-sheet form, and the suction pressure is adjusted to about 250 mmAg by an adjusting cock 17*b*. At this moment, the solenoid valve 17*a* is closed. Because the cut-sheet form is closely attached to and carried on the conveyor belt 14, there is no possibility of defective conveyance, such as slipping of the cut-sheet form on the conveyor belt 14 when it is separated from the surface of the drum 7, sharing of the toner when the toner on the surface of the drum 7 is transferred to the form, or abutting of the curled form against other components.

On the other hand, the change-over flapper 20 is directed upward at its front end in the printing of the fan-fold form. The suction pressure is adjusted to about 150 mmAg by an adjusting cock 17*c* through opening of the solenoid valve 17*a*. In addition, the fan-fold form is maintained at a proper form tension of 800 g between the tractor 3 and the discharging puller 19, and the conveyor belt 14.

At this moment, the load acting on the conveyor belt 14 is no different from that in the printing of the cut-sheet form, and therefore, the driving torque of the conveyor belt 14 is maintained at about 3 kg-cm.

The suction mechanism according to the above arrangement can separately adjust the suction pressure to the proper value for printing either the fan-fold form or the cut-sheet form so that, in feeding the cut-sheet form, it will adhere firmly to the conveyor belt 14. Therefore, sharing of the toner on the cut-sheet form and defective conveyance of the form can be effectively prevented.

On the other hand, because, in the printing of the fan-fold form, it is possible to set the suction pressure at a low level required for it proper conveyance, it is possible to prevent the perforation h of the form from being torn by the pin 3*a* of the tractor 3 through increase of tensile force on the form during printing. In addition, the load acting on the conveyor belt 14 can be maintained at a low level so that the driving mechanism such as the stepping motor 18*a* for driving the belt 14 and the like, and the driver for controlling the motor can be made small in size and inexpensive. Furthermore, reducing the load acting on the driving section also reduces the amount of wear on the driving section and the aging. Therefore, it is possible to prevent the problem of the stepping motor becoming out of step by a load increase caused by aging.

On the printer of the invention, as described above, both the cut-sheet and the fan-fold forms are selectively printed through the transfer section C of the single configuration, and the fixing section P, and conveyed to the form discharging mechanism 18 by the conveyor belt 14 in the fixing portion P.

It is convenient in handling that each printed form being conveyed is discharged to respective stackers 25 and 26 provided, depending on the type of the forms. In addition, in case of the cut-sheet form, it is also convenient in handling of the printed cut-sheet form to be able to select functions to stack the printed face up or to stack the printed face down.

Figure 8:
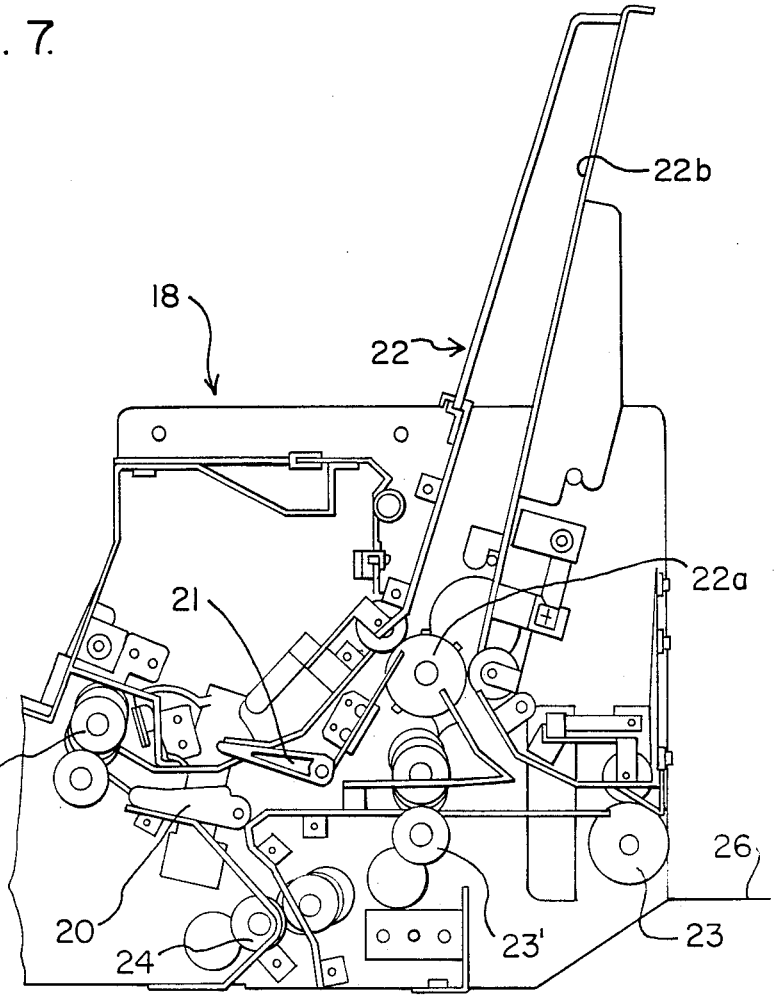
FIG. 8 is a cross-sectional side view illustrating an embodiment of the form path switching section in the form discharging means.

Thus, the invention provides a form discharging path branched by the first flapper 20, as shown in FIGS. 1 and 8, in the form discharging mechanism 18 located at the rear portion of the fixing section 18. It is arranged so that the form path branched by the first flapper 20 located close to the transfer section C of the image divided for the printed fan-fold form FF and the cut-sheet form CS causes each form to run in its respective path. In addition, the path for the cut-sheet form branched by the second flapper 21 located far from the transfer section C is divided into a face-up side and a face-down side of the cut-sheet form to cause the form to run in its respective path.

Furthermore, independent stacking areas are provided for the printed fan-fold form FF and the cut-sheet form CS so that changing-over of the operation of printing between the fan-fold form and the cut-sheet form can be quickly accommodated, while the stacking tray can be shared for the stacking position of the fan-fold form FF and for the cut-sheet form CS that is discharged by the face-up/face-down function.

An embodiment of the above arrangement is described by referring to FIGS. 1 and 8. It should be noticed that the side view of the form discharging mechanism 18 of FIG. 8 is depicted in a view opposite to that of FIG. 1.

Thus, the printed fan-fold form FF is fed into the form discharging mechanism 18 by the discharging puller 19 through the fixing section P. When the first flapper 20 for changing over the path is directed downward, the form FF runs under the bottom of the flapper, is fed out on the stacker 25 by a stacker puller 24, and stacked while being arranged by a paddle 25*a*.

On the other hand, when the the first flapper 20 for changing over the paths for fan-fold/cut-sheet form is directed downward, the printed cut-sheet form CS goes to the path for the cut-sheet form indicated by an arrow a. The orientation of the cut-sheet form CS is determined by the action of the second flapper 21, which changes the face-up and the face-down of the cut-sheet form CS, in response to an instruction from a controller (not shown), and follows the determined path.

For example, when the second flapper 21 is directed downward under a face-down instruction, the cut-sheet form CS advances to the path at the side of the form reversing means 22, and is stacked on the cut-sheet form tray 26 with its printed surface down through the reversing roller 22*a*, the reversing plate 22*b* and the feed-out roller 23.

On the other hand, when the second flapper 21 is directed upward in response to a face-up instruction (the state shown in FIG. 8), the cut-sheet form CS advances straight as it is, and is stacked on the cut-sheet form tray 26 with its printed surface up through the feed roller 23' and the feed-out roller 23.

As described, in the printer of the invention, the fan-fold form FF and the cut-sheet form CS are selectively printed while sharing the transfer section C and the fixing section P, and then, stacked on the stacker 25 and the cut-sheet form tray 26, respectively, which are independently provided. Therefore, for example, once the fan-fold form FF is cut by a cutter immediately after its printing, and discharged onto its stacker 25, printing of the cut-sheet form CS can be started immediately. Here, if the fan-fold form FF is still loaded on the tractor 3, because an operation opposite to the above can be performed, it is possible to improve the availability factor per printer.

In addition, it is possible to arbitrary select either face-up or face-down stacking of the cut-sheet form CS by switching the second flapper 21.

Furthermore, because the fan-fold form FF is arranged to be discharged below the path changeover section according to the first flapper 20, and stacked, the printed fan-fold form FF can be stored at the lower portion of the printing mechanism with good space efficiency. This allows the overall floor space occupied by the printer and the access area of the operator to be reduced.

On the other hand, the reversing means 22 for the cut-sheet form is arranged by positioning the reversing plate 22*b* over the form discharging mechanism 18 with an angle as the path for facedown forms, designing the reversing of the form in a switch-back method with good space efficiency, and forming in a shape with a large curvature allowing smooth reversing or passing of a thick cut-sheet form CS with a greater stiffness. Thus, the reversing means 22 can be mounted compactly in the machine, and can reverse even a thick form in a good condition for stacking.

In addition, because the same tray 26 is arranged to be shared by the cut-sheet form in both the face-up and the face-down state, it is possible to make the machine compact, and to integrate handling of printed forms. Thus, the operability can be expected to improve.

As described, in the invention it is rationalized that a separate printer is not required for each type of form because, in an electrophotographic printer such as a laser beam printer, only form feeding paths of its form feeding means and form discharging paths of its form discharging means are separately provided for the fan-fold form and the cut-sheet form, but a transfer section and a fixing section, which form essential components of the printer, are provided as a single configuration so that both forms can be selectively printed. It also has an advantage in that the entire printer can be easily designed in a compact structure and shape because the essential components of the machine can be shared for both forms.

In addition, members constituting the transfer section and the fixing section of the printer according to the invention that are rotated, run, or elevated during printing are driven and controlled in the most suitable conditions for a form to be printed, depending on whether it is a cut-sheet form or a fan-fold form, so that even the single transfer section and fixing section shared by both forms can handle each form in a manner suitable for its printing or conveying conditions, and therefore, has an advantage in that the printer performs optimum printing for each form.

Furthermore, a single printer can perform selective printing and stacking of the fan-fold form and the cut-sheet form so that a significant reduction can be attained in the requirements of the power supply, supplies, maintenance parts, and conditions for the location of use.

What is claimed is:

1. An electrophotographic printer comprising a photosensitive drum comprising;

a form feeder having means for feeding cut sheets to said photosensitive drum and means for feeding fan-fold forms to said photosensitive drum both means being provided in parallel adjacent to said photosensitive drum;

a frame being driven toward said photosensitive drum to allow forms fed by said form feeder to make contact with said photosensitive drum;

means provided on said frame for transferring images on said photosensitive drum to the forms made contact with said drum;

a conveyor belt for sucking forms from said transfer means with a suction pressure to convey said forms;

means for fixing transferred images on the forms conveyed by said conveyor belt; and means for discharging the forms from said fixing means.

2. An electrophotographic printer as claimed in claim 1, wherein the circumferential speed of said photosensitive drum is controlled to be slightly lower than the conveying speed of the forms when fan-fold forms are used, and to be the same as the conveying speed of the forms when cut sheets are used.

3. An electrophotographic printer as claimed in claim 2, wherein the rotation of said photosensitive drum is so controlled as to stop when the fan-fold forms are cut.

4. An electrophotographic printer as claimed in claim 3, further comprising means for driving said frame toward said photosensitive drum so that the gap between the photosensitive drum and the frame when fan-fold forms are used is smaller than the gap between the photosensitive drum and the frame when cut sheets are used, and for driving the frame away from the drum when printing is not being performed.

5. An electrophotographic printer as claimed in claim 4, wherein said frame is so fabricated that the gap between the photosensitive drum and the frame during printing is larger in the conveyor belt side than in the form feeder side.

6. An electrophotographic printer as claimed in claim 5, further comprising a presser guide for pushing forms to widen the gap between the photosensitive drum and the forms when printing is not being performed.

7. An electrophotographic printer as claimed in claim 6, wherein the speed of said conveyor belt in the form conveying direction is so controlled as to be higher when fan-fold forms are used than the speed when cut sheets are used.

8. An electrophotographic printer as claimed in claim 7, wherein said suction pressure is so controlled as to be higher when cut sheets are used than the pressure when fan-fold forms are used.

9. An electrophotographic printer as claimed in claim 8, wherein the path in said form discharging means is branched by a first flapper into a cut sheet path and a fan-fold path, and said cut sheet path is branched by a second flapper into a path to a form reversing means and a form forwarding path.

* * * * *

UNITED STATES PATENT AND TRADEMARK OFFICE

CERTIFICATE OF CORRECTION

PATENT NO. : 4,929,982

DATED : May 29, 1990

INVENTOR(S) : Masayuki Ainoya; Takeyuki Ishihara; Tesuo Kanno; Takahiro Kikuchi; Seiichi Mori; Shogo Nobumori; Junji Shirakawa.

It is certified that error appears in the above-identified patent and that said Letters Patent is hereby corrected as shown below:

Assignee: International Business Machines Corporation, Armonk, N.Y.

Should read:

Assignee: International Business Machines Corporation, Armonk, N.Y. and Hitachi Koki Company Limited, Tokyo, Japan Signed and Sealed this Eighth Day of March, 1994

*Attest:*

Bruce Lehman

BRUCE LEHMAN

*Attesting Officer*

*Commissioner of Patents and Trademarks*